United States Patent [19]

Hill et al.

[11] Patent Number: 4,862,707

[45] Date of Patent: Sep. 5, 1989

[54] TWO COMPARTMENT REFRIGERATOR

[75] Inventors: Richard C. Hill, Orono; James C. LaBrecque, Bangor, both of Me.

[73] Assignee: University of Maine System, Orono, Me.

[21] Appl. No.: 254,028

[22] Filed: Oct. 6, 1988

[51] Int. Cl.[4] ..... F25D 11/02

[52] U.S. Cl. ..... 62/431; 62/432; 62/438; 62/442

[58] Field of Search ..... 62/441, 442, 431, 432, 62/434, 438, 228.5, 333, 334

[56] References Cited

U.S. PATENT DOCUMENTS

| | | | |
|---|---|---|---|
| 2,120,185 | 6/1938 | Philipp | 62/438 X |
| 2,257,925 | 10/1941 | Vretman | 62/431 X |
| 2,428,311 | 9/1947 | Herbener | 62/431 X |
| 2,428,312 | 9/1947 | Herbener | 62/432 |
| 2,511,851 | 6/1950 | Iwashita | 62/438 X |
| 2,694,297 | 11/1954 | Shoemaker | 62/432 X |
| 4,383,421 | 5/1983 | Quesnoit | 62/442 X |

*Primary Examiner*—Lloyd L. King
*Attorney, Agent, or Firm*—Henry D. Pahl Jr.

[57] ABSTRACT

The refrigeration system disclosed herein provides separate chilling and freezing compartments and operates in alternate phases. In the first phase, an evaporator which controls chilling compartment temperature also absorbs heat from a thermal mass through the change of phase of a liquid to a solid. In the second phase, this evaporator becomes a condenser for the operation of a second evaporator associated with the freezer component. During this second phase, the heat transfer is reversed, the fusion energy of the first phase is recaptured as melting energy in the second. Accordingly, heat is transferred from the second evaporator to the mass over a temperature differential which is less than that existing between the second evaporator and the environment.

5 Claims, 1 Drawing Sheet

TWO COMPARTMENT REFRIGERATOR

BACKGROUND OF THE INVENTION

The present invention relates to refrigeration systems and more particularly to a refrigeration system useful in a domestic refrigerator of the type having separate chilling and freezing compartments.

Environmental concerns are providing an impetus for, on the one hand, household refrigerators that are more energy efficient and, on the other hand, refrigeration systems which do not employ ozone-deleterious refrigerants. Unfortunately, in conventional refrigerator designs, these two considerations are to some extent contradictory. In order to provide the low temperatures required for storing frozen foods, a high compression ratio is needed necessitating a refrigerant such as R-12. This refrigerant has a high ozone depletion factor. The desirable refrigerants from the point of view of ozone depletion, e.g. R-22, are not well suited to low temperature refrigeration, i.e. applications where sub zero temperatures are needed, because they are not suited for high compression ratios.

Among the several objects of the present invention may be noted the provision of a refrigeration system which facilitates the use of low compression ratio refrigerants; the provision of such a refrigeration system which is very energy efficient; the provision of such a refrigeration system which is well suited for utilization in domestic refrigerators; the provision of such a refrigeration system which will facilitate the providing of two independent suction temperatures; the provision of such a refrigeration system which is highly reliable and which is of relatively simple and inexpensive construction. Other objects and features will be in part apparent and in part pointed out hereinafter.

SUMMARY OF THE INVENTION

Briefly, a refrigeration system according to the present invention employs a conventional condenser and compressor together with a pair of evaporators, a first of which is thermally coupled to a mass providing appreciable thermal inertia. These components are interconnected by conduit means including valving which is operative in a first state for directing refrigerant flow from the compressor through the condenser and thence through the first evaporator and is operative in a second state for directing refrigerant flow through the first evaporator, then operating as a condenser, and thence through the second evaporator. Accordingly, in the second state, heat is transferred from the second evaporator to the mass over a temperature differential which is less than the temperature differential between the second evaporator and the environment of the condenser.

BRIEF DESCRIPTION OF THE DRAWING

The FIGURE is a schematic diagram of a refrigerator employing a refrigeration system constructed in accordance with the present invention.

DESCRIPTION OF THE PREFERRED EMBODIMENT

Figure 1:
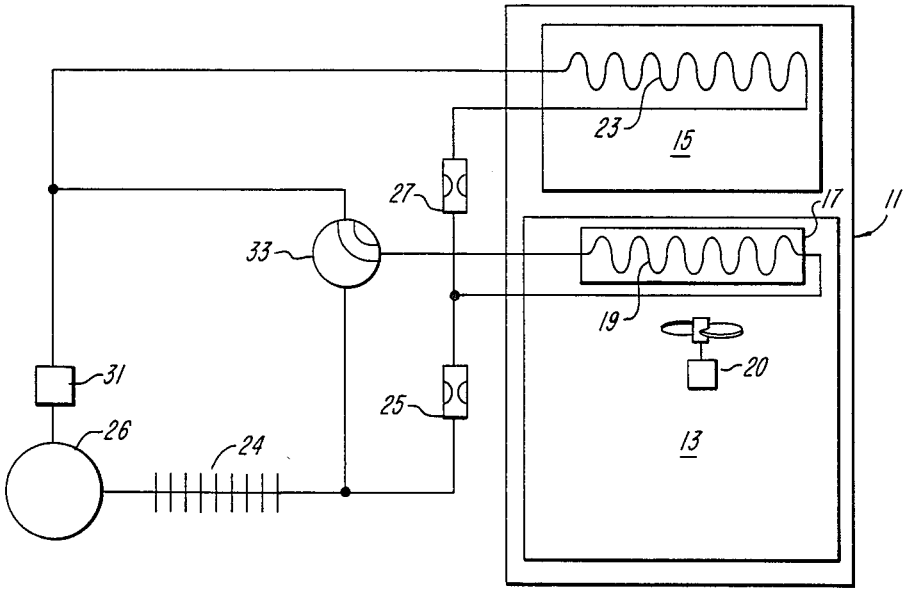

Referring now to the drawing, there is indicated by reference character 11 generally a household refrigerator having a chilling compartment 13 and a freezer compartment 15. Within the chilling compartment 13 is a sealed water tank 17 within which is located a first evaporator 19. The function of sealed water tank 17 is to constitute a mass providing appreciable thermal inertia or energy storing. Water in a tank is presently preferred for the refrigerator environment since, at freezing temperature, substantial heat storage is provided by the heat required for phase change. Further, it is appropriate to maintain temperatures in the chilling compartment 13 by means of a body which is itself maintained just at freezing temperature. A thermostatically controlled fan 20 coupled to said thermal mass 17 is provided for controlling the absorption of heat from the chilling compartment 13.

A second evaporator 23 is located within the freezer compartment 15. As will be understood by those skilled in the art, the evaporator 23 must generate temperatures substantially below freezing so as to maintain frozen foods within the freezer compartment 15.

A compressor is provided as indicated at reference character 26. For reasons which will be explained in greater detail hereinafter, the compressor 26 may be designed to operate at relatively low compression ratios and thus may be of lower cost than the compressors employed in conventional refrigerators as manufactured heretofore. A condenser 24 is provided on the outlet side of compressor 26 for ejecting heat into the environment of the refrigerator 11 in conventional fashion.

Refrigerant may be fed to the evaporator 19 through a capillary tube 25 and to the evaporator 23 through a capillary tube 27. As is understood, the capillary tubes act as metering devices. The inlet side of the capillary tube 25 is connected to the outlet side of the condenser 24. It may be noted, however, that the inlet side of the capillary tube 27 is connected in to a point between the evaporator 19 and its capillary tube 25 rather than being connected directly to the outlet of the condenser.

The side of evaporator 23 opposite its capillary tube 27 is connected to the suction side of the compressor, preferably through a refrigerant accumulator 31. The side of evaporator 19 opposite its capillary tube 25 is selectively connected to the same inlet point through a three-way valve 33. A third port on the three-way valve 33 is connected to a point between the condenser 24 and the capillary tube 25. The three-way valve 33 permits the refrigeration system illustrated to operate in either of two states. In the first state, which is the state shown, the evaporator 19 connects back to the suction side of the compressor 26. In the alternate state, the evaporator 19 is connected indirectly to the compressor outlet and operates as a condenser.

OPERATION

In use, the refrigeration system is initially operated with a three-way valve 33 in its first state, as shown. In this state, refrigerant is pumped through the condenser 24 where heat is ejected and thence, by way of the capillary tube 25, to the evaporator 19 where it expands and chills the thermal mass tank 17. The system is operated in this state until the water in the tank 17 is frozen. This condition may be determined thermostatically, i.e. by sensing when the temperature starts to deviate above or below the freezing level. Since the pressure of the refrigerant is dropped by the capillary tube 25 to a value only slightly above the compressor inlet pressure, very little refrigerant flow will take place through the evaporator 23 and thus substantially all the cooling will take place over only the temperature differential which exists between the chilling compartment and the environment of the refrigerator in which the condenser 24 is located. Accordingly, the compression ratio over which the compressor 26 operates will be substantially lower than that experienced in conventional refrigerators where all heat absorption occurs at the freezing compartment temperature.

After the thermal mass water tank 17 has been suitably chilled, the three-way valve 33 is switched to its second state in which the left hand side of the evaporation 19 is connected to the outlet side of the compressor. In this second state or phase of operation, the evaporator 19 acts essentially as a condenser allowing heat to be ejected into the thermal mass at its current temperature, i.e. essentially at freezing. Refrigerant exiting the evaporator 19 from the right side is still at relatively high pressure and thus will flow, through the capillary tube 27, into the evaporator 23 within the freezer compartment 15 where heat will be picked up and the freezer compartment will be cooled. Refrigerant leaving the evaporator 23 returns to the inlet side of the compressor 26. In this mode the compressor is operated in response to the temperature in the freezer compartment. During this phase of operation, the compressor again operates over a relatively modest pressure differential since, although heat is being picked up at relatively low temperature, i.e. well below freezing, it is being ejected at a temperature which is not warmer by any great differential, i.e. the freezing temperature of the thermal mass water tank 17.

As may be seen from the foregoing description, the refrigeration system of the present invention is capable of providing the functions of a domestic refrigerator, including the generation of subfreezing temperatures, without having to employ compression ratios or pressure differentials corresponding to the entire temperature differential between desired subfreezing temperatures and the ambient heat rejection temperature. Rather, the system operates in two states, each of which involves only a relatively modest compression ratio. This reduction in compression ratio as compared with conventional refrigerators allows the use of environmentally desirable refrigerants as indicated previously. It also yields significantly greater energy efficiency since cooling of the chilling space 13 is provided by pumping over a pressure ratio corresponding to the temperature differential between the chilling compartment and ambient rather than between pressures corresponding to the differential between the freezer temperature at the environment as is the case with conventional refrigerators in which cooling for the chilling compartment is effectively borrowed from the freezer compartment.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A refrigeration system comprising:
a condenser;
a compressor;
a mass providing appreciable thermal inertia;
thermally coupled to said mass, a first evaporator;
a second evaporator;
conduit means interconnecting the aforesaid components, said conduit means including valve means operative in a first state for directing refrigerant flow from said compressor through said condenser and thence through said first evaporator in a first direction and operative in a second state for directing refrigerant flow from said compressor through said first evaporator in a direction opposite said first direction and thence through said second evaporator
whereby, in said second state, heat is transferred from said second evaporator to said mass over a temperature differential established by prior operation with said valve means in said first state, which temperature differential is substantially less than the temperature differential between said second evaporator and said condenser.

2. A refrigeration system as set forth in claim 1 comprising first and second metering devices, one being interposed between said condenser and said first evaporator and the second metering device being interposed between the first metering device and said second evaporator.

3. A refrigeration system as set forth in claim 2 wherein one end of said first evaporator is connected between said metering devices.

4. In a refrigerator having a chilled compartment and a freezing compartment, a refrigeration system comprising:
in said chilling compartment, a mass providing appreciable thermal inertia;
thermally coupled to said mass, a first evaporator;
outside said compartments, a condenser;
a compressor;
in said freezing compartment, a second evaporator;
conduit means interconnecting said compressor, said condenser, and said first and second evaporators, said conduit means including valving means operative in a first state for directing refrigerant flow from said compressor through said condenser and thence through said first evaporator in a first direction and operative in a second state for directing refrigerant flow from said compressor through said first evaporator in a direction opposite said first direction and thence through said second evaporator
whereby, in said second state, heat is transferred from said second evaporator to said mass over a temperature differential established by prior operation with said valve means in said first state, which temperature differential is substantially less than the temperature differential between said second evaporator and said condenser.

5. A refrigerator system as set forth in claim 4 further comprising a thermostatically controlled fan coupled to said mass for controlling absorption of heat from said chilling compartment.

* * * * *